United States Patent [19]

Smith

[11] 4,290,565

[45] Sep. 22, 1981

[54] YARN TENSION DEVICE

[76] Inventor: Leonard R. Smith, 721 Green St., Raeford, N.C. 28370

[21] Appl. No.: 130,094

[22] Filed: Mar. 13, 1980

[51] Int. Cl.[3] ..... B65H 59/22

[52] U.S. Cl. ..... 242/152.1

[58] Field of Search ..... 242/152.1, 147 R, 149, 242/157 R, 157 C

[56] References Cited

U.S. PATENT DOCUMENTS

| | | | |
|---|---|---|---|
| 1,490,512 | 4/1924 | Hill et al. | 242/152.1 |
| 1,785,987 | 12/1930 | Stewart | 242/152.1 X |
| 2,369,266 | 2/1945 | Thurnauer | 242/157 R X |
| 3,753,535 | 8/1973 | Zollinger | 242/152.1 |
| 3,874,613 | 4/1975 | Zollinger | 242/152.1 |
| 3,892,371 | 7/1975 | Zollinger | 242/152.1 |
| 4,019,701 | 4/1977 | McCullough | 242/152.1 |

FOREIGN PATENT DOCUMENTS

| | | | |
|---|---|---|---|
| 5256 | of 1913 | United Kingdom | 242/152.1 |
| 3487 | of 1914 | United Kingdom | 242/152.1 |

*Primary Examiner*—Stanley N. Gilreath
*Attorney, Agent, or Firm*—Mills & Coats

[57] ABSTRACT

This invention is a yarn tension device for use on textile creels and similar adaptations. A plurality of individual tension devices are formed from an aluminum alloy and are secured to a bar which in turn is mounted on the creel. Not only is the warping of brackets holding the tension devices eliminated, but also static electricity is bled off thus eliminating the precipitator effect which causes a build-up of wax and lint through the magnetic attraction of static electrical charges. Further a means is provided for preventing the tension balls or bearings from being removed from the devices during the threading of yarn therethrough.

5 Claims, 3 Drawing Figures

YARN TENSION DEVICE

FIELD OF INVENTION

This invention relates to textile equipment and more particularly to yarn tensioning devices.

BACKGROUND OF INVENTION

In the past various means have been used to control the tension of yarn or thread on textile equipment. These means have included disc-shaped members with the yarn running therebetween, various other pressure friction means, and more recently cup-like members generally made of plastic or similar material with the yarn passing axially therethrough and being tensioned by a metal ball bearing-like member contained within the cup. Tensioning devices of this type are simple and yet highly efficient with the tension being variable by varying the size and weight of the balls.

Wear is always a problem in tensioning means. Ceramic inserts in the bottom of the cup and in the center of the cover or lid used in conjunction therewith eliminated the excessive wear problem but not the excessive build-up of wax and lint due to the magnetic attraction of static electricity created by the fast moving yarn through the device.

Also the brackets that mounted the prior art tension means very quickly warp under the heat and vibration of operation so that the device is no longer aligned with the yarn. When this happens, either excessive tension or inadequate tension is encountered. Since the entire textile machine in many instances must be shut down to replace the tension devices used therewith, they are allowed to continue to run even though they are twisted or distorted to a point of near uselessness. This, of course, can very quickly affect the quality of the product being manufactured as well as creating expensive down-time for the equipment.

Further, during the threading of the yarn through the prior known tensioning devices, the cap is removed therefrom so that a threading wire can be run therethrough. Because of the large number of tensioning devices that must be threaded, the operator very often in his haste will knock the tension ball or bearing out of the cup and the same will roll across the floor of the plant creating an under-foot hazard as well as being not readily retrievable. The entire threading process must then be stopped until the ball can be replaced in the cup. Additionally, the operator will quite often leave the cap off of the cup, particularly if the same has become distorted due to heat or other causes and does not fit properly. During later operation of the machine, the jerking of the yarn will cause the ball to be thrown from the cup thus again creating an under-foot hazard as well as rendering the tension means completely useless.

BRIEF DESCRIPTION OF INVENTION

After much research and study into the abovementioned problems, the present invention has been developed to provide a textile yarn tensioning device adapted to be used in conjunction with standard size, side, umbrella or overhead creels and similar applications. These devices are manufactured from an aluminum alloy to within critical tolerances and internal configurations to give uniform predetermined tensioning under varying circumstances over extremely extended periods of time. Each of the individual tension devices is mounted on a bar which is grounded to the creel or other device thus giving not only extended life but an anti-static means to prevent build-up of lint and wax thus eliminating the clogging effect of the same.

The present invention also includes a provision for preventing the tension bearings from inadvertently being removed or otherwise being propelled from the tension cups and yet allows the same to be readily threaded prior to operation.

In view of the above, it is an object of the present invention to provide a yarn tensioning device formed from an aluminum alloy and grounded through its mounting system whereby static electricity is bled off and prevented from building up a precipitator effect.

Another object of the present invention is to provide an improved yarn tensioning device wherein a plurality of tension cups are mounted on a single support bar.

Another object of the present invention is to provide a yarn tension device wherein the angular disposition of the device is prevented from warping or otherwise coming distorted.

Another object of the present invention is to provide a yarn tension device with means to allow yarn to be threaded therethrough without danger of dislocating the tension ball contained therein.

Another object of the present invention is to provide a yarn tension device which is for all practical purposes impervious to wear and yet is easily mounted on a standard textile creel.

Another object of the present invention is to provide a simple and highly efficient means for preventing a tension bearing from becoming dislodged from the cup of a yarn tension device and yet replacement of the bearing can be readily accomplished when a change of tension is desired.

Other objects and advantages of the present invention will become apparent and obvious from a study of the following description and the accompanying drawings which are merely illustrative of such invention.

DETAILED DESCRIPTION OF INVENTION

Figure 1:
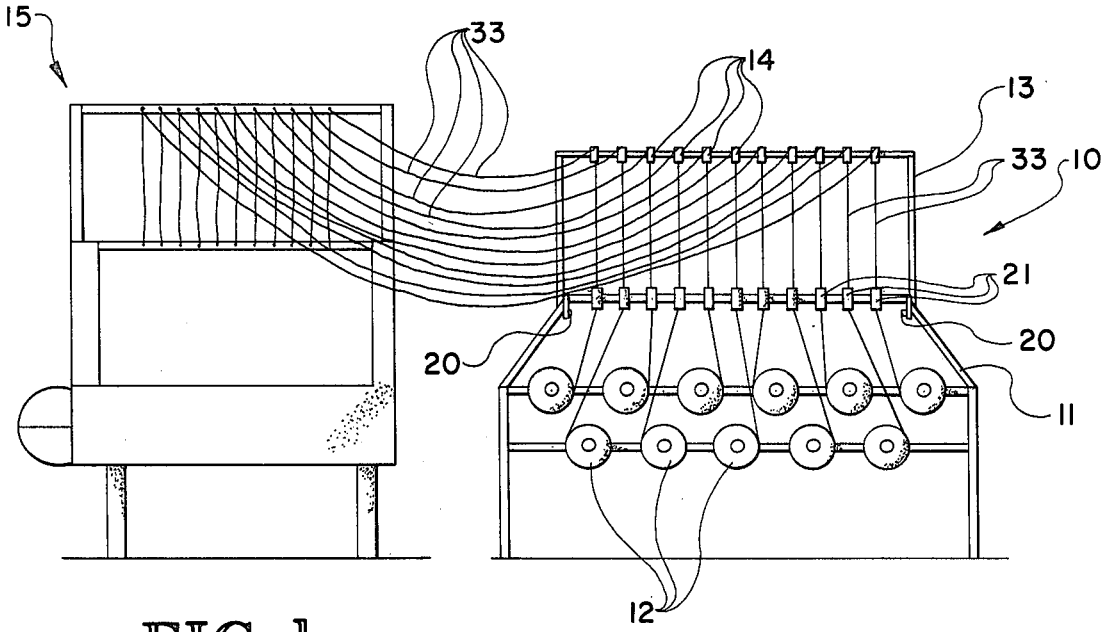
FIG. 1 is an elevational view, in somewhat schematic form, showing a textile type creel with the yarn tension device of the present invention mounted thereon.

With further reference to the drawings, a standard textile type creel is indicated generally at 10 and includes a lower frame 11 which mounts yarn packages 12 in the normal manner. An upper frame 13 is provided on creel 10 which mounts yarn stop motions 14. From the stop motions, the yarn passes to the textile machine, indicated generally at 15, in the normal manner.

The yarn tension means of the present invention, indicated generally at 16, includes an elongated mounting bar 17 formed from an aluminum alloy or other suitable material. To each end of this bar is fixedly secured a mounting bracket 18 as can clearly be seen in FIGS. 1 and 2.

An opening 19 is provided in each bracket 18 and is adapted to receive a securing means such as bolt 20 to removingly mount tension device 16 on creel 10.

A plurality of tension cups 21 are secured at spaced intervals to bar 17 by means such as weldment 22. Each of these cups are preferably machined from alloy 6061-T6 aluminum with an overall length of 1.500 to 1.525 inches with a longitudinal interior diameter of 0.460 inch. The chamber 23 for receiving the tension ball 32 is preferably 1.250 to 1.257 inches in length with the seat of the chamber being beveled to a 30 degree angle as indicated at 24. A center hole 25 is provided in the lower bore portion of cup 21 and is adapted to receive a ceramic insert or eyelet 26.

Eyelet 26 includes a groove portion 27 adapted to receive a suitable cement for bonding such eyelet to cup 21. Also shoulder 28 is provided on the bottom portion of the eyelet and is adapted to lie juxtaposed to the bottom 29 of cup 21.

Figure 2:
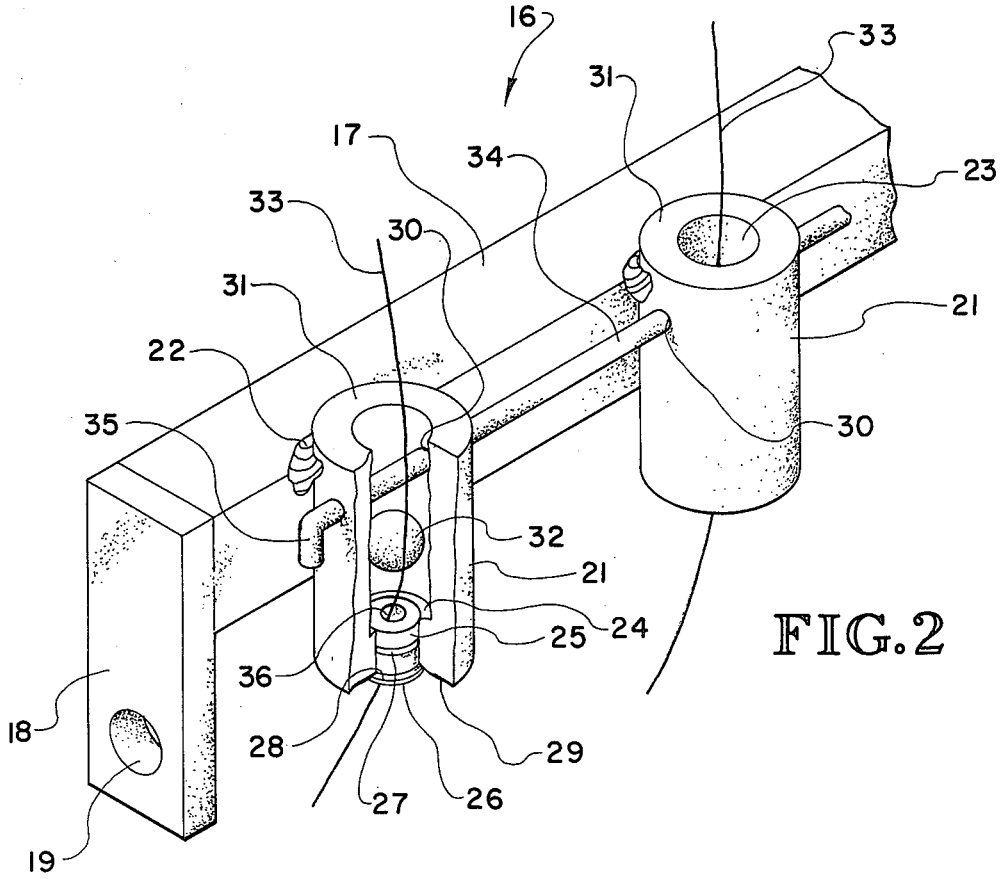
FIG. 2 is a partially cutaway, fragmentary view of the present invention.
Figure 3:
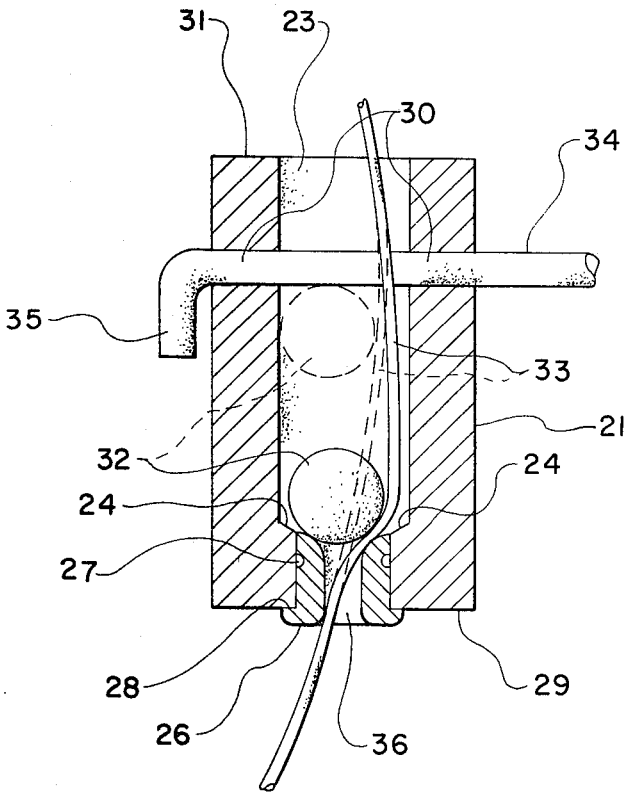
FIG. 3 is an enlarged sectional view of one of the tension cups.

Horizontal openings 30 of approximately 0.125 inch diameter are machined in axial alignment from one cup to the next as can be clearly seen in FIG. 2. These holes are preferably centered at 0.250 inch from the top 31 of cups 21. A single strand 34 of 0.090 inch diameter, specially hardened music wire is adapted to be passed through each of the cups 21 to retain the tension balls 32 therein. These balls are preferably of the ball bearing type and ordinarily would be of either the 0.3125 or 0.375 inch diameter type depending on the amount of tension desired to be applied to the yarn 33. Since the basic concept of using a ball bearing as a tension means is well known to those skilled in the art, further discussion of this portion of the present invention is not deemed necessary.

The retaining strand or bar 34 of special hardened music wire is disposed within openings 30 as indicated above. This retaining bar or strand is bent or otherwise manipulated as indicated at 35 to prevent the same from accidentally being removed from openings 30 of cups 21 during use.

When the yarn tension device 16 of the present invention has been appropriately mounted on creel 10, yarn 33 is fed up through central opening 36 of eyelet 26, pass tension ball 32 in chamber 23, and out the top 31 of cup 21. The yarn is then fed through the appropriate stop motion 14 and to textile machine 15.

As can clearly be seen in FIG. 2, the retaining bar or strand 34 not only acts to prevent ball 32 from accidentally being removed from cup 31 but also can act as a yarn guide if the yarn does not feed in axial alignment from cup 21.

Whenever it is desired to replace the tension balls 32 within cups 21 to change the weight of the same and thus the amount of tension delivered, the bent portion 35 of bar 34 can be straightened (or other retaining means removed) so that the bar can be slipped from the cups 21 and the balls changed. The retaining bar is then replaced and tension device of the present invention is ready for continued operation.

From the above, it can be seen that the present invention has the advantage of providing a yarn tension device wherein the individual tension cups are machined from a special aluminum alloy to precise tolerances. The hardened retaining bar passing through the tension cups serves not only to retain the tension balls but also can act as a yarn guide. Having a plurality of yarn cups mounted on a single mounting bar, installation of the tension devices of the present invention is simple and easy to expedite and yet has the additional advantage of providing a metal to metal grounding effect so that any static electricity built up by the passing of the yarn through the tension device will be bled off thus preventing electromagnetic attraction of lint, wax and other foreign materials. An even further advantage of the present invention is that, because of the materials used in the construction thereof, the same is practically indestructible with the useful life of the device being many times that of similar prior art tension means.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A device for use in conjunction with a textile type machine for tensioning a plurality of yarns, said device comprising: a mounting bar; means for mounting said bar for use in conjunction with said machine; a plurality of cup means fixedly secured to said bar; each cup means having a centrally disposed chamber therein through which a yarn is threaded and in which a tension applying ball is disposed; and an elongated ball retaining means extending through said plurality of cup means and across one end of the chambers of said plural cup means for retaining said balls within said chambers during threading of the yarns therethrough as well as during machine operation.

2. The device of claim 1 wherein the retaining means is a specially hardened piano type wire.

3. The device of claim 1 wherein the cup means are composed of an alloy aluminum.

4. The device of claim 3 wherein said cup means, mounting bar and bar mounting means are composed of an electrically conductive material whereby said cup means can be effectively grounded to prevent the build up of static electrical charges therein.

5. The device of claim 1 wherein said device is operatively mounted on a textile type creel.

* * * * *